US012225940B2

(12) United States Patent
Moloney

(10) Patent No.: US 12,225,940 B2
(45) Date of Patent: Feb. 18, 2025

(54) ATOMIZER FOR A VAPOR PROVISION SYSTEM

(71) Applicant: NICOVENTURES TRADING LIMITED, London (GB)

(72) Inventor: Patrick Moloney, London (GB)

(73) Assignee: NICOVENTURES TRADING LIMITED, London (GB)

( * ) Notice: Subject to any disclaimer, the term of this patent is extended or adjusted under 35 U.S.C. 154(b) by 553 days.

(21) Appl. No.: 17/593,309

(22) PCT Filed: Mar. 11, 2020

(86) PCT No.: PCT/GB2020/050586
§ 371 (c)(1),
(2) Date: Sep. 15, 2021

(87) PCT Pub. No.: WO2020/188244
PCT Pub. Date: Sep. 24, 2020

(65) Prior Publication Data

US 2022/0202090 A1 Jun. 30, 2022

(30) Foreign Application Priority Data

Mar. 15, 2019 (GB) ..... 1903539

(51) Int. Cl.
*A24F 40/465* (2020.01)
*A24F 40/42* (2020.01)
*A24F 40/44* (2020.01)

(52) U.S. Cl.
CPC ..... *A24F 40/465* (2020.01); *A24F 40/42* (2020.01); *A24F 40/44* (2020.01)

(58) Field of Classification Search
CPC ..... A24F 40/465; A24F 40/42; A24F 40/44; A24F 40/10; H05B 6/105
(Continued)

(56) References Cited

U.S. PATENT DOCUMENTS 5,665,262 A 9/1997 Hajaligol et al.
9,854,841 B2 1/2018 Ampolini et al.
(Continued)

FOREIGN PATENT DOCUMENTS

CA 2946480 A1 11/2015
CN 107708454 A 2/2018
(Continued)

OTHER PUBLICATIONS

International Search Report and Written Opinion for PCT/GB2020/050586 date mailed Jun. 3, 2020.
(Continued)

*Primary Examiner* — Alexander Gilman
(74) *Attorney, Agent, or Firm* — Husch Blackwell

(57) ABSTRACT

An aerosol source for an electronic vapor provision system, comprises a reservoir housing defining a reservoir for holding aerosolizable substrate material; and an elongate atomizer to which aerosolizable substrate material from the reservoir is deliverable for vaporization, the atomizer having a porosity and comprising a susceptor for induction heating, and having a first end and a second end, the atomizer mounted at one of its ends only so as to be supported at the mounted end in a cantilevered arrangement having an unsupported cantilever portion, such that the susceptor extends outwardly with respect to an exterior boundary of the reservoir housing.

19 Claims, 6 Drawing Sheets

(58) Field of Classification Search
USPC ..... 131/329
See application file for complete search history.

(56) References Cited

U.S. PATENT DOCUMENTS

| | | | | |
|---|---|---|---|---|
| 10,004,263 | B2 * | 6/2018 | Liu | H05B 1/0227 |
| 10,045,568 | B2 * | 8/2018 | Monsees | H05B 3/44 |
| 10,674,771 | B2 * | 6/2020 | Buchberger | A61M 11/042 |
| 10,869,366 | B2 * | 12/2020 | Rojo-Calderon | A24F 40/465 |
| 10,881,141 | B2 * | 1/2021 | Fraser | A24B 15/167 |
| 11,033,055 | B2 * | 6/2021 | Fraser | A24F 40/465 |
| 11,185,110 | B2 * | 11/2021 | Fraser | A24F 40/42 |
| 11,324,258 | B2 * | 5/2022 | Batista | A24F 40/85 |
| 11,382,358 | B2 * | 7/2022 | Batista | A24F 40/465 |
| 11,470,883 | B2 * | 10/2022 | Kaufman | H05B 6/365 |
| 2015/0320116 | A1 | 11/2015 | Bleloch et al. | |
| 2017/0071260 | A1 * | 3/2017 | Li | A24F 40/42 |
| 2017/0202266 | A1 * | 7/2017 | Sur | A61M 11/041 |
| 2017/0280771 | A1 | 10/2017 | Courbat et al. | |
| 2018/0289067 | A1 * | 10/2018 | Courbat | A24F 40/44 |
| 2020/0128880 | A1 * | 4/2020 | Gage | A24F 42/60 |
| 2021/0329977 | A1 * | 10/2021 | Sur | A24F 40/60 |
| 2023/0056177 | A1 * | 2/2023 | Short | A24F 40/42 |

FOREIGN PATENT DOCUMENTS

| | | | |
|---|---|---|---|
| CN | 108451045 | A | 8/2018 |
| CN | 108471813 | A | 8/2018 |
| EA | 012481 | B1 | 10/2009 |
| EP | 3420829 | | 1/2019 |
| JP | 2018529311 | A | 10/2018 |
| JP | 2019010090 | A | 1/2019 |
| RU | 2665447 | C2 | 8/2018 |
| WO | 2014120479 | A1 | 8/2014 |
| WO | 2016156213 | A1 | 10/2016 |
| WO | WO2017109448 | | 6/2017 |
| WO | 2018211252 | A1 | 11/2018 |

OTHER PUBLICATIONS

"International Preliminary Report on Patentability received for PCT Patent Application No. PCT/GB2020/050586, completed on May 10, 2021", 6 pages.

"Office Action received for Russian Patent Application No. 2021127009, mailed on Feb. 25, 2022", 10 pages.

"Office Action received for Chinese Patent Application No. 20208002044.1, mailed on Apr. 28, 2024", 14 pages (8 pages of English Translation and 6 pages of Official Copy).

* cited by examiner

ATOMIZER FOR A VAPOR PROVISION SYSTEM

The present application is a National Phase entry of PCT Application No. PCT/GB2020/050586, filed Mar. 11, 2020 which claims priority from GB Patent Application No. 1903539.3 filed Mar. 15, 2019, each of which is hereby fully incorporated herein by reference.

TECHNICAL FIELD

The present disclosure relates to an atomizer for a vapor provision system, and a cartomizer for a vapor provision system and a vapor provision system which comprise such an atomizer.

BACKGROUND

Many electronic vapor provision systems, such as e-cigarettes and other electronic nicotine delivery systems that deliver nicotine via vaporized liquids, are formed from two main components or sections, namely a cartridge or cartomizer section and a control unit (battery section). The cartomizer generally includes a reservoir of liquid and an atomizer for vaporizing the liquid. These parts may collectively be designated as an aerosol source. The atomizer generally combines the functions of porosity or wicking and heating in order to transport liquid from the reservoir to a location where it is heated and vaporized. For example, it may be implemented as an electrical heater, which may be a resistive wire formed into a coil or other shape for resistive (Joule) heating or a susceptor for induction heating, and a porous element with capillary or wicking capability in proximity to the heater which absorbs liquid from the reservoir and carries it to the heater. The control unit generally includes a battery for supplying power to operate the system. Electrical power from the battery is delivered to activate the heater, which heats up to vaporize a small amount of liquid delivered from the reservoir. The vaporized liquid is then inhaled by the user.

The components of the cartomizer can be intended for short term use only, so that the cartomizer is a disposable component of the system, also referred to as a consumable. In contrast, the control unit is typically intended for multiple uses with a series of cartomizers, which the user replaces as each expires. Consumable cartomizers are supplied to the consumer with a reservoir pre-filled with liquid, and intended to be disposed of when the reservoir is empty. For convenience and safety, the reservoir is sealed and designed not to be easily refilled, since the liquid may be difficult to handle. It is simpler for the user to replace the entire cartomizer when a new supply of liquid is needed.

In this context, it is desirable that cartomizers are straightforward to manufacture and comprise few parts. They can hence be efficiently manufactured in large quantities at low cost with minimum waste. Cartomizers of a simple design are hence of interest.

SUMMARY

According to a first aspect of some embodiments described herein, there is provided an aerosol source for an electronic vapor provision system, comprising: a reservoir housing defining a reservoir for holding aerosolizable substrate material; and an elongate atomizer to which aerosolizable substrate material from the reservoir is deliverable for vaporization, the atomizer having a porosity and comprising a susceptor for induction heating, and having a first end and a second end, the atomizer mounted at one of its ends only so as to be supported at the mounted end in a cantilevered arrangement having an unsupported cantilever portion, such that the susceptor extends outwardly with respect to an exterior boundary of the reservoir housing.

According to a second aspect of some embodiments described herein, there is provided a cartridge for an electronic vapor provision system comprising an aerosol source according to the first aspect.

According to a third aspect of some embodiments described herein, there is provided an electronic vapor provision system comprising an aerosol source according to the first aspect or a cartridge according to the second aspect, and further comprising a coil configured to receive electrical power in order to heat the susceptor by induction heating.

These and further aspects of the certain embodiments are set out in the appended independent and dependent claims. It will be appreciated that features of the dependent claims may be combined with each other and features of the independent claims in combinations other than those explicitly set out in the claims. Furthermore, the approach described herein is not restricted to specific embodiments such as set out below, but includes and contemplates any appropriate combinations of features presented herein. For example, an atomizer or a vapor provision system including an atomizer may be provided in accordance with approaches described herein which includes any one or more of the various features described below as appropriate.

BRIEF DESCRIPTION OF THE DRAWINGS

Various embodiments of the invention will now be described in detail by way of example only with reference to the following drawings in which:

FIGS. 4, 4(A), 4(B) and 4(C) show simplified schematic cross-sectional views of a further example cartomizer in which aspects of the disclosure can be implemented;

DETAILED DESCRIPTION

Figure 1:
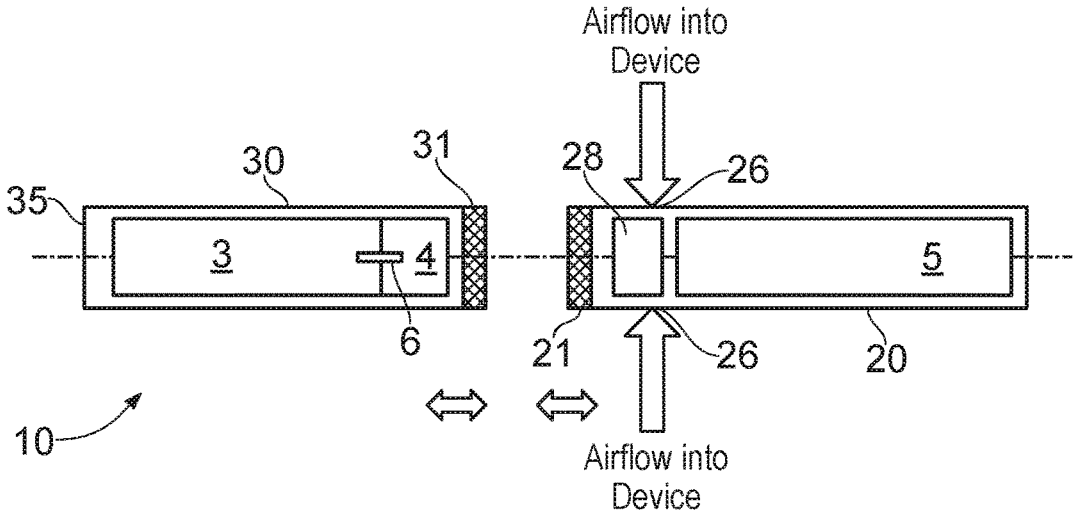
FIG. 1 shows a cross-section through an example e-cigarette comprising a cartomizer and a control unit.

Aspects and features of certain examples and embodiments are discussed/described herein. Some aspects and features of certain examples and embodiments may be implemented conventionally and these are not discussed/described in detail in the interests of brevity. It will thus be appreciated that aspects and features of apparatus and methods discussed herein which are not described in detail may be implemented in accordance with any conventional techniques for implementing such aspects and features.

As described above, the present disclosure relates to (but is not limited to) electronic aerosol or vapor provision systems, such as e-cigarettes. Throughout the following description the terms "e-cigarette" and "electronic cigarette" may sometimes be used; however, it will be appreciated these terms may be used interchangeably with aerosol (vapor) provision system or device. The systems are intended to generate an inhalable aerosol by vaporization of a substrate in the form of a liquid or gel which may or may not contain nicotine. Additionally, hybrid systems may comprise a liquid or gel substrate plus a solid substrate which is also heated. The solid substrate may be for example tobacco or other non-tobacco products, which may or may not contain nicotine. The term "aerosolizable substrate material" as used herein is intended to refer to substrate materials which can form an aerosol, either through the application of heat or some other means. The term "aerosol" may be used interchangeably with "vapor".

As used herein, the term "component" is used to refer to a part, section, unit, module, assembly or similar of an electronic cigarette or similar device that incorporates several smaller parts or elements, possibly within an exterior housing or wall. An electronic cigarette may be formed or built from one or more such components, and the components may be removably or separably connectable to one another, or may be permanently joined together during manufacture to define the whole electronic cigarette. The present disclosure is applicable to (but not limited to) systems comprising two components separably connectable to one another and configured, for example, as an aerosolizable substrate material carrying component holding liquid or another aerosolizable substrate material (a cartridge, cartomizer or consumable), and a control unit having a battery for providing electrical power to operate an element for generating vapor from the substrate material. For the sake of providing a concrete example, in the present disclosure, a cartomizer is described as an example of the aerosolizable substrate material carrying portion or component, but the disclosure is not limited in this regard and is applicable to any configuration of aerosolizable substrate material carrying portion or component. Also, such a component may include more or fewer parts than those included in the examples.

The present disclosure is particularly concerned with vapor provision systems and components thereof that utilize aerosolizable substrate material in the form of a liquid or a gel which is held in a reservoir, tank, container or other receptacle comprised in the system. An arrangement for delivering the substrate material from the reservoir for the purpose of providing it for vapor/aerosol generation is included. The terms "liquid", "gel", "fluid", "source liquid", "source gel", "source fluid" and the like may be used interchangeably with "aerosolizable substrate material" and "substrate material" to refer to aerosolizable substrate material that has a form capable of being stored and delivered in accordance with examples of the present disclosure.

FIG. 1 is a highly schematic diagram (not to scale) of a generic example aerosol/vapor provision system such as an e-cigarette 10, presented for the purpose of showing the relationship between the various parts of a typical system and explaining the general principles of operation. The e-cigarette 10 has a generally elongate shape in this example, extending along a longitudinal axis indicated by a dashed line, and comprises two main components, namely a control or power component, section or unit 20, and a cartridge assembly or section 30 (sometimes referred to as a cartomizer or clearomiser) carrying aerosolizable substrate material and operating as a vapor-generating component.

The cartomizer 30 includes a reservoir 3 containing a source liquid or other aerosolizable substrate material comprising a formulation such as liquid or gel from which an aerosol is to be generated, for example containing nicotine. As an example, the source liquid may comprise around 1 to 3% nicotine and 50% glycerol, with the remainder comprising roughly equal measures of water and propylene glycol, and possibly also comprising other components, such as flavorings. Nicotine-free source liquid may also be used, such as to deliver flavoring. A solid substrate (not illustrated), such as a portion of tobacco or other flavor element through which vapor generated from the liquid is passed, may also be included. The reservoir 3 has the form of a storage tank, being a container or receptacle in which source liquid can be stored such that the liquid is free to move and flow within the confines of the tank. For a consumable cartomizer, the reservoir 3 may be sealed after filling during manufacture so as to be disposable after the source liquid is consumed, otherwise, it may have an inlet port or other opening through which new source liquid can be added by the user. The cartomizer 30 also comprises an electrically powered heating element or heater 4 located externally of the reservoir tank 3 for generating the aerosol by vaporization of the source liquid by heating. A liquid transfer or delivery arrangement (liquid transport element) such as a wick or other porous element 6 may be provided to deliver source liquid from the reservoir 3 to the heater 4. A wick 6 may have one or more parts located inside the reservoir 3, or otherwise be in fluid communication with the liquid in the reservoir 3, so as to be able to absorb source liquid and transfer it by wicking or capillary action to other parts of the wick 6 that are adjacent or in contact with the heater 4. This liquid is thereby heated and vaporized, to be replaced by new source liquid from the reservoir for transfer to the heater 4 by the wick 6. The wick may be thought of as a bridge, path or conduit between the reservoir 3 and the heater 4 that delivers or transfers liquid from the reservoir to the heater. Terms including conduit, liquid conduit, liquid transfer path, liquid delivery path, liquid transfer mechanism or element, and liquid delivery mechanism or element may all be used interchangeably herein to refer to a wick or corresponding component or structure.

A heater and wick (or similar) combination is sometimes referred to as an atomizer or atomizer assembly, and the reservoir with its source liquid plus the atomizer may be collectively referred to as an aerosol source. Other terminology may include a liquid delivery assembly or a liquid transfer assembly, where in the present context these terms may be used interchangeably to refer to a vapor-generating element (vapor generator) plus a wicking or similar component or structure (liquid transport element) that delivers or transfers liquid obtained from a reservoir to the vapor generator for vapor/aerosol generation. Various designs are possible, in which the parts may be differently arranged compared with the highly schematic representation of FIG. 1. For example, the wick 6 may be an entirely separate element from the heater 4, or the heater 4 may be configured to be porous and able to perform at least part of the wicking function directly (a metallic mesh, for example). In an electrical or electronic device, the vapor generating element may be an electrical heating element that operates by ohmic/resistive (Joule) heating or by inductive heating. In general, therefore, an atomizer can be considered as one or more elements that implement the functionality of a vapor-generating or vaporizing element able to generate vapor from source liquid delivered to it, and a liquid transport or delivery element able to deliver or transport liquid from a reservoir or similar liquid store to the vapor generator by a wicking action/capillary force. An atomizer is typically housed in a cartomizer component of a vapor generating system. In some designs, liquid may be dispensed from a reservoir directly onto a vapor generator with no need for a distinct wicking or capillary element. Embodiments of the disclosure are applicable to all and any such configurations which are consistent with the examples and description herein.

Returning to FIG. 1, the cartomizer 30 also includes a mouthpiece or mouthpiece portion 35 having an opening or air outlet through which a user may inhale the aerosol generated by the atomizer 4.

The power component or control unit 20 includes a cell or battery 5 (referred to herein after as a battery, and which may be re-chargeable) to provide power for electrical components of the e-cigarette 10, in particular to operate the heater 4. Additionally, there is a controller 28 such as a printed circuit board and/or other electronics or circuitry for generally controlling the e-cigarette. The control electronics/circuitry 28 operates the heater 4 using power from the battery 5 when vapor is required, for example in response to a signal from an air pressure sensor or air flow sensor (not shown) that detects an inhalation on the system 10 during which air enters through one or more air inlets 26 in the wall of the control unit 20. When the heating element 4 is operated, the heating element 4 vaporizes source liquid delivered from the reservoir 3 by the liquid delivery element 6 to generate the aerosol, and this is then inhaled by a user through the opening in the mouthpiece 35. The aerosol is carried from the aerosol source to the mouthpiece 35 along one or more air channels (not shown) that connect the air inlet 26 to the aerosol source to the air outlet when a user inhales on the mouthpiece 35.

The control unit (power section) 20 and the cartomizer (cartridge assembly) 30 are separate connectable parts detachable from one another by separation in a direction parallel to the longitudinal axis, as indicated by the double-ended arrows in FIG. 1. The components 20, 30 are joined together when the device 10 is in use by cooperating engagement elements 21, 31 (for example, a screw or bayonet fitting) which provide mechanical and in some cases electrical connectivity between the power section 20 and the cartridge assembly 30. Electrical connectivity is required if the heater 4 operates by ohmic heating, so that current can be passed through the heater 4 when it is connected to the battery 5. In systems that use inductive heating, electrical connectivity can be omitted if no parts requiring electrical power are located in the cartomizer 30. An inductive work coil can be housed in the power section 20 and supplied with power from the battery 5, and the cartomizer 30 and the power section 20 shaped so that when they are connected, there is an appropriate exposure of the heater 4 to flux generated by the coil for the purpose of generating current flow in the material of the heater. Inductive heating arrangements are discussed further below. The FIG. 1 design is merely an example arrangement, and the various parts and features may be differently distributed between the power section 20 and the cartridge assembly section 30, and other components and elements may be included. The two sections may connect together end-to-end in a longitudinal configuration as in FIG. 1, or in a different configuration such as a parallel, side-by-side arrangement. The system may or may not be generally cylindrical and/or have a generally longitudinal shape. Either or both sections or components may be intended to be disposed of and replaced when exhausted (the reservoir is empty or the battery is flat, for example), or be intended for multiple uses enabled by actions such as refilling the reservoir and recharging the battery. In other examples, the system 10 may be unitary, in that the parts of the control unit 20 and the cartomizer 30 are comprised in a single housing and cannot be separated. Embodiments and examples of the present disclosure are applicable to any of these configurations and other configurations of which the skilled person will be aware.

Figure 2:
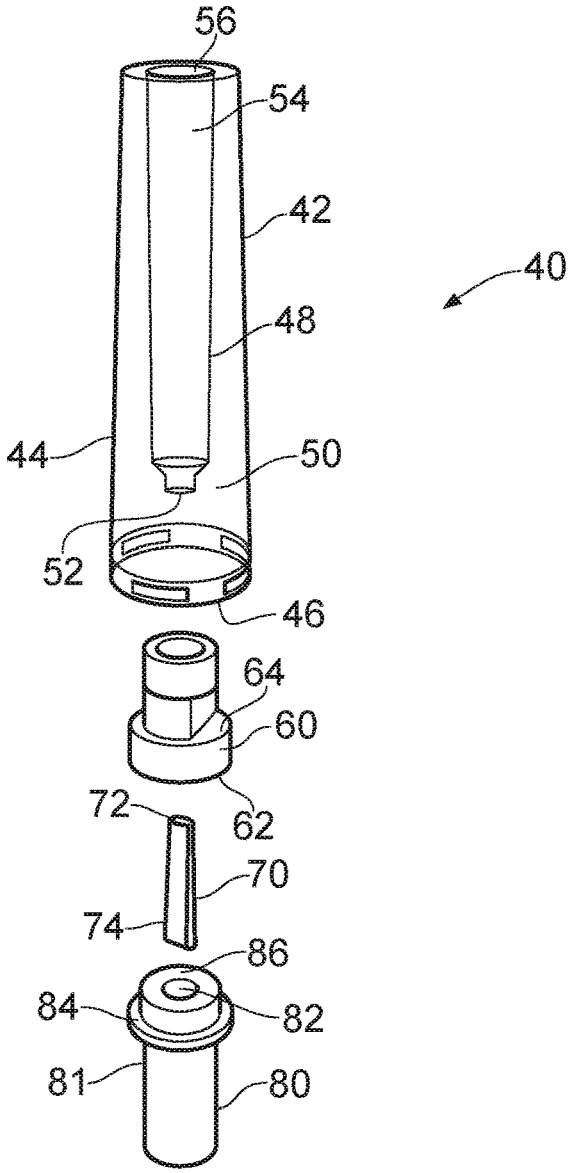
FIG. 2 shows an external perspective exploded view of an example cartomizer in which aspects of the disclosure can be implemented.

FIG. 2 shows an external perspective view of parts which can be assembled to form a cartomizer according to an example of the present disclosure. The cartomizer 40 comprises four parts only, which can be assembled by being pushed or pressed together if appropriately shaped. Hence, fabrication can be made very simple and straightforward.

A first part is a housing 42 that defines a reservoir for holding aerosolizable substrate material (hereinafter referred to as a substrate or a liquid, for brevity). The housing 42 has a generally tubular shape, which in this example has a circular cross-section, and comprises a wall or walls shaped to define various parts of the reservoir and other items. A cylindrical outer side wall 44 is open at its lower end at an opening 46 through which the reservoir may be filled with liquid, and to which parts can be joined as described below, to close/seal the reservoir and also enable an outward delivery of the liquid for vaporization. This defines an exterior or external volume or dimensions of the reservoir. References herein to elements or parts lying or being located externally to the reservoir are intended to indicate that the part is outside or partially outside the region bounded or defined by this outer wall 44 and its upper and lower extent and edges or surfaces.

A cylindrical inner wall 48 is concentrically arranged within the outer side wall 44. This arrangement defines an annular volume 50 between the outer wall 44 and the inner wall 48 which is a receptacle, cavity, void or similar to hold liquid, in other words, the reservoir. The outer wall 44 and the inner wall 48 are connected together (for example by a top wall or by the walls tapering towards one another) in order to close the upper edge of the reservoir volume 50. The inner wall 48 is open at its lower end at an opening 52, and also at its upper end. The tubular inner space bounded by the inner wall is an air flow passage or channel 54 that, in the assembled system, carries generated aerosol from an atomizer to a mouthpiece outlet of the system for inhalation by a user. The opening 56 at the upper end of the inner wall 48 can be the mouthpiece outlet, configured to be comfortably received in the user's mouth, or a separate mouthpiece part can be coupled on or around the housing 42 having a channel connecting the opening 56 to a mouthpiece outlet.

The housing 42 may be formed from molded plastic material, for example by injection molding. In the example of FIG. 2, it is formed from transparent material; this allows the user to observe a level or amount of liquid in the reservoir 44. The housing might alternatively be opaque, or opaque with a transparent window through which the liquid level can be seen. The plastic material may be rigid in some examples.

A second part of the cartomizer 40 is a flow directing member 60, which in this example also has a circular cross-section, and is shaped and configured for engagement with the lower end of the housing 42. The flow directing member 60 is effectively a bung, and is configured to provide a plurality of functions. When inserted into the lower end of the housing 42, it couples with the opening 46 to close and seal the reservoir volume 50 and couples with the opening 52 to seal off the air flow passage 54 from the reservoir volume 50. Additionally, the flow directing member 60 has at least one channel passing through it for liquid flow, which carries liquid from the reservoir volume 50 to a space external to the reservoir which acts as an aerosol chamber where vapor/aerosol is generated by heating the liquid. Also the flow directing member 60 has at least one other channel passing through it for aerosol flow, which carries the generated aerosol from the aerosol chamber space to the air flow passage 54 in the housing 42, so that it is delivered to the mouthpiece opening for inhalation.

Also, the flow directing member 60 may be made from a flexible resilient material such as silicone so that it can be easily engaged with the housing 46 via a friction fit. Additionally, the flow directing member has a socket or similarly-shaped formation (not shown) on its lower surface 62, opposite to the upper surface or surfaces 64 which engage with the housing 42. The socket receives and supports an atomizer 70, being a third part of the cartomizer 40.

The atomizer 70 has an elongate shape with a first end 72 and a second end 74 oppositely disposed with respect to its elongate length. In the assembled cartomizer, the atomizer is mounted at its first end 72 which pushed into the socket of the flow directing member 60 in a direction towards the reservoir housing 42. The first end 72 is therefore supported by the flow directing member 60, and the atomizer 70 extends lengthwise outwardly from the reservoir substantially along the longitudinal axis defined by the concentrically shaped parts of the housing 42. The second end 74 of the atomizer 70 is not mounted, and is left free. Accordingly, the atomizer 70 is supported in a cantilevered manner extending outwardly from the exterior bounds of the reservoir. The atomizer 70 performs a wicking function and a heating function in order to generate aerosol, and may comprise any of several configurations of an electrically resistive heater portion configured to act as an inductive susceptor, and a porous portion configured to wick liquid from the reservoir to the vicinity of the heater.

A fourth part of the cartomizer 40 is an enclosure or shroud 80. Again, this has a circular cross-section in this example. It comprises a cylindrical side wall 81 closed by a an optional base wall to define a central hollow space or void 82. The upper rim 84 of the side wall 81, around an opening 86, is shaped to enable engagement of the enclosure 80 with reciprocally shaped parts on the flow directing member 60 so that the enclosure 80 can be coupled to the flow directing member 60 once the atomizer 70 is fitted into the socket on the flow directing member 60. The flow directing member 60 hence acts as a cover to close the central space 82, and this space 82 creates an aerosol chamber in which the atomizer 70 is disposed. The opening 86 allows communication with the liquid flow channel and the aerosol flow channel in the flow directing member 60 so that liquid can be delivered to the atomizer and generated aerosol can be removed from the aerosol chamber. In order to enable a flow of air through the aerosol chamber to pass over the atomizer 70 and collect the vapor such that it becomes entrained in the air flow to form an aerosol, the wall or walls 81 of the enclosure 80 have one or more openings or perforations to allow air to be drawn into the aerosol chamber when a user inhales via the mouthpiece opening of the cartomizer.

The enclosure 80 may be formed from a plastics material, such as by injection molding. It may be formed from a rigid material, and can then be readily engaged with the flow directing member by pushing or pressing the two parts together.

As noted above, the flow directing member can be made from a flexible resilient material, and may hold the parts coupled to it, namely the housing 42, the atomizer 70 and the enclosure 80, by friction fit. Since these parts may be more rigid, the flexibility of the flow directing member, which enables it to deform somewhat when pressed against these other parts, accommodates any minor errors in the manufactured size of the parts. In this way, the flow directing part can absorb manufacturing tolerances of all the parts while still enabling quality assembly of the parts altogether to form the cartomizer 40. Manufacturing requirements for making the housing 42, the atomizer 70 and the enclosure 80 can therefore be relaxed somewhat, reducing manufacturing costs.

Figure 3:
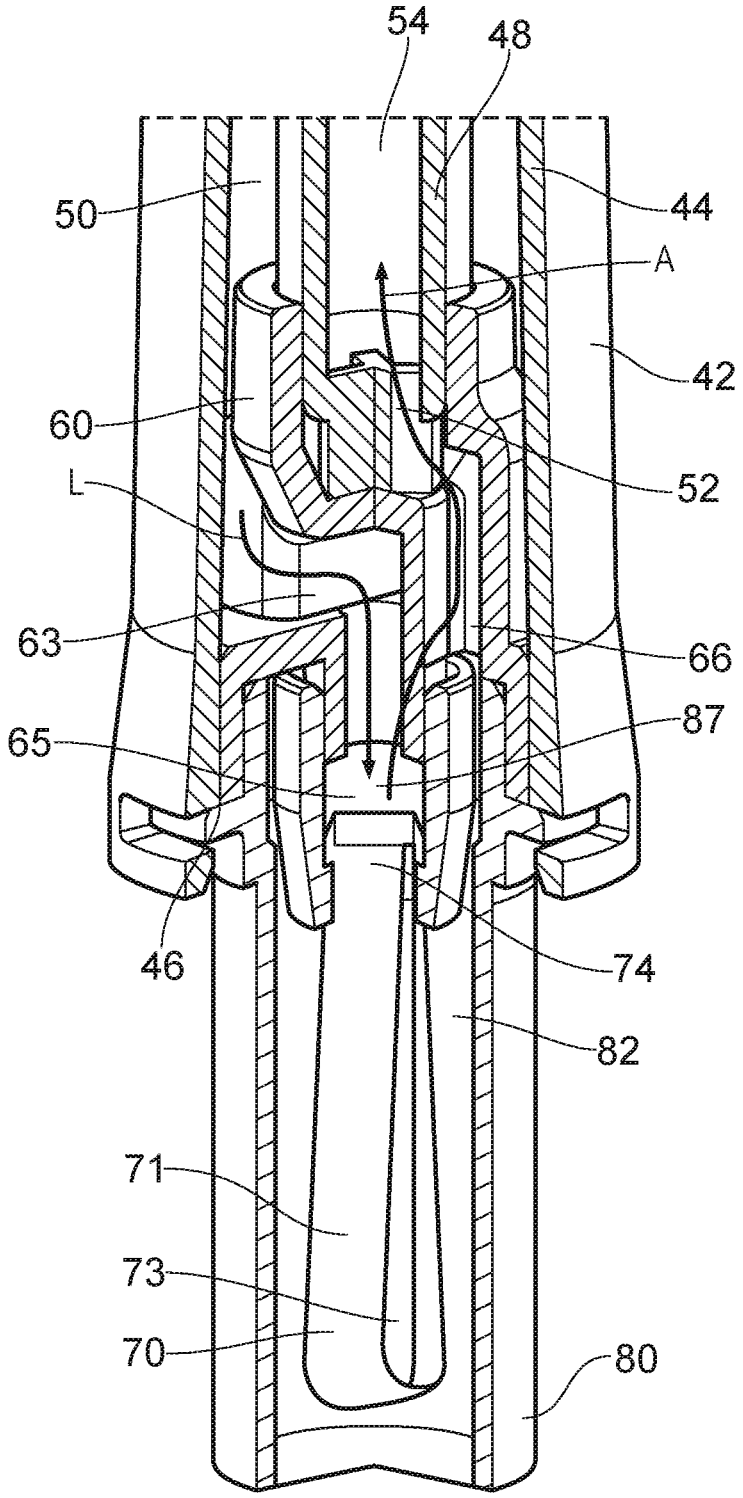
FIG. 3 shows a partially cut-away perspective view of the cartomizer of FIG. 2 in an assembled arrangement.

FIG. 3 shows a cut-away perspective view of the cartomizer of FIG. 1 in an assembled configuration. For clarity, the flow directing member 60 is shaded. It can be seen how the flow directing member 60 is shaped on its upper surfaces to engage around the opening 52 defined by the lower edge of the inner wall 48 of the reservoir housing 42, and concentrically outwardly to engage in the opening 46 defined by the lower edge of the outer wall 44 of the housing 42, in order to seal both reservoir space 50 and the air flow passage 54.

The flow directing member 60 has a liquid flow channel 63 which allows the flow of liquid substrate material L from the reservoir volume 50 through the flow directing member into a space or volume 65 under the flow directing member 60. Also, there is an aerosol flow channel 66 which allows the flow of aerosol and air A from the space 65 through the flow directing member 60 to the air flow passage 54.

The enclosure 80 is shaped at its upper rim to engage with corresponding shaped parts in the lower surface of the flow directing member 60, to create the aerosol chamber 82 substantially outside the exterior dimensions of the volume of the reservoir 50 according to the reservoir housing 42. In this example, the enclosure 80 has an aperture 87 in its upper end proximate the flow directing member 60. This coincides with the space 65 with which the liquid flow channel 63 and the aerosol flow channel 66 communicate, and hence allows liquid to enter the aerosol chamber 82 and aerosol to leave the aerosol chamber 82 via the channels in the flow directing member 60.

In this example, the aperture 87 also acts as a socket for mounting the first, supported, end 74 of the atomizer 70 (recall that in the FIG. 2 description, the atomizer socket was mentioned as being formed in the flow directing member, either option can be used). Thus, liquid arriving through the liquid flow channel 63 is fed directly to the first end of the atomizer 70 for absorption and wicking, and air/aerosol can be drawn through and past the atomizer to enter the aerosol flow channel 66.

In this example, the atomizer 70 comprises a planar elongate portion of metal 71 which is folded or curved at its midpoint to bring the two ends of the metal portion adjacent to one another at the first end of the atomizer 74. This acts as the heater component of the atomizer 70. A portion of cotton or other porous material 73 is sandwiched between the two folded sides of the metal portion. This acts as the wicking component of the atomizer 70. Liquid arriving in the space 65 is collected by the absorbency of the porous wick material 73 and carried downwards to the heater. Many other arrangements of an elongate atomizer suitable for cantilevered mounting are also possible and may be used instead.

The heater component is intended for heating via induction, which will be described further below.

The example of FIGS. 2 and 3 has parts with substantially circular symmetry in a plane orthogonal to the longitudinal dimension of the assembled cartomizer. Hence, the parts are free from any required orientation in the planes in which they are joined together, which can give ease of manufacture. The parts can be assembled together in any orientation about the axis of the longitudinal dimension, so there is no requirement to place the parts in a particular orientation before assembly. This is not essential, however, and the parts may be alternatively shaped.

Figure 4:
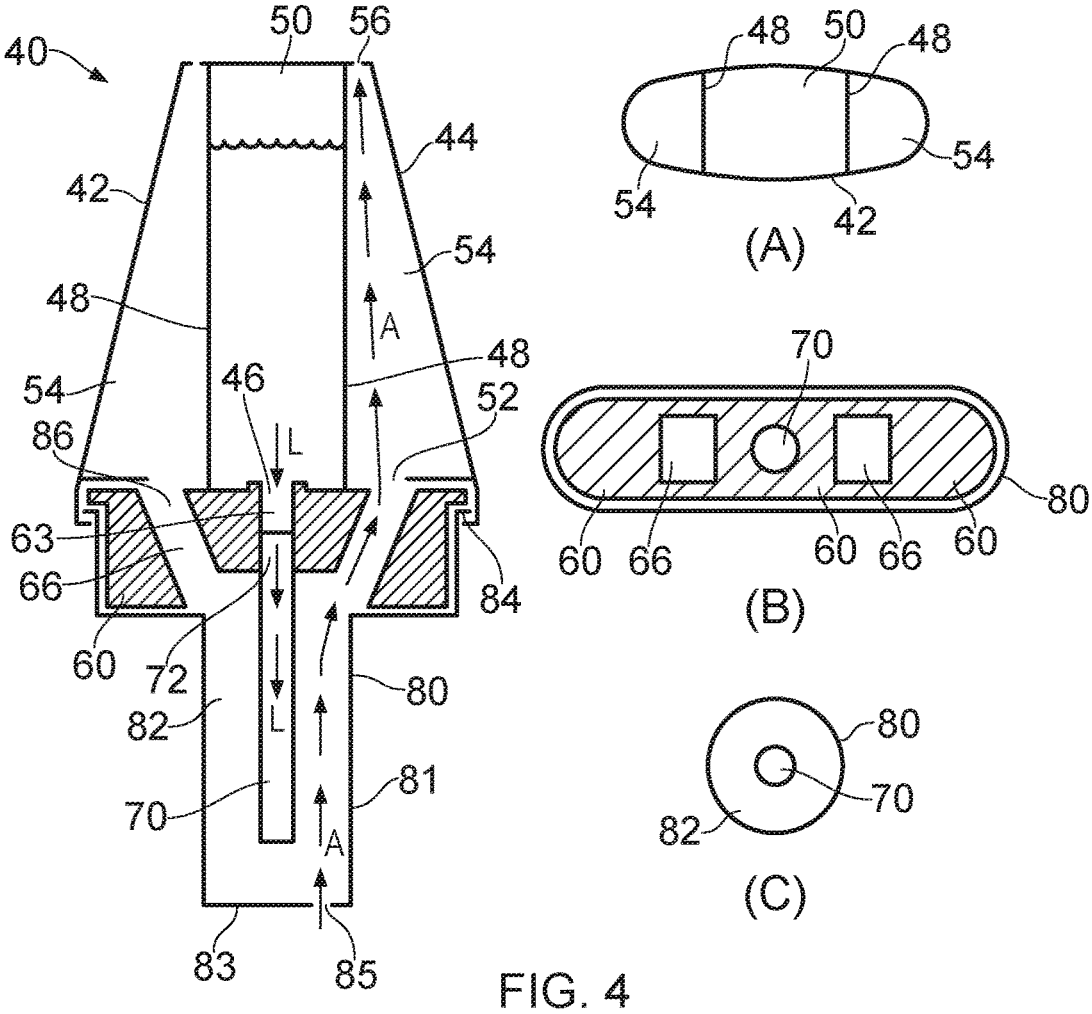

FIG. 4 shows a cross-sectional view through a further example assembled cartomizer comprising a reservoir housing, a flow directing member, an atomizer and an enclosure, as before. In this example, though, in the plane orthogonal to the longitudinal axis of the cartomizer 40, at least some of the parts have an oval shape instead of a circular shape, and are arranged to have symmetry along the major axis and the minor axis of the oval. Features are reflected on either side of the major axis and on either side of the minor axis. This means that for assembly the parts can have either of two orientations, rotated from each other by 180° about the longitudinal axis. Again, assembly is simplified compared to a system comprising parts with no symmetry.

In this example, the enclosure 80 again comprises a side wall 81, which is formed so as to have a varying cross-section at different points along the longitudinal axis of the enclosure, and a base wall 83, which bound a space that creates the aerosol chamber 82. Towards its upper end, the enclosure broadens out to a large cross-section to give room to accommodate the flow directing member 60. The large cross-section portion of the enclosure 80 has a generally oval cross-section (see FIG. 4(B)), while the narrower cross-section portion of the enclosure has a generally circular cross-section (see FIG. 4(C)). The enclosure's upper rim 84, around the top opening 86, is shaped to engage with corresponding shaping on the reservoir housing 42. This shaping and engagement is shown in simplified form in FIG. 4; in reality it is likely to be more complex in order to provide a reasonably air-tight and liquid-tight join. The enclosure 80 has at least one opening 85, in this case in the base wall 83, to allow air to enter the aerosol chamber during user inhalation.

The reservoir housing 42 is differently shaped compared with the FIGS. 2 and 3 example. The outer wall 44 defines an interior space which is divided into three regions by two inner walls 48. The regions are arranged side by side. The central region, between the two inner walls 48 is the reservoir volume 50 for holding liquid. This region is closed at the top by a top wall of the housing. An opening 46 in the base of the reservoir volume allows liquid to be delivered from the reservoir 50 to the aerosol chamber 82. The two side regions, between the outer wall 44 and the inner walls 48, are the air flow passages 54. Each has an opening 52 at its lower end for aerosol to enter, and a mouthpiece opening 56 at its upper end (as before, a separate mouthpiece portion might be added externally to the reservoir housing 42).

A flow directing member 60 (shaded for clarity) is engaged into the lower edge of the housing 42, via shaped portions to engage with the openings 46 and 52 in the housing 42 to close/seal the reservoir volume 50 and the air flow passages 54. The flow directing member 60 has a single centrally disposed liquid flow channel 63 aligned with the reservoir volume opening 46 to transport liquid L from the reservoir to the aerosol chamber 82. Further, there are two aerosol flow channels 66, each running from an inlet at the aerosol chamber 82 to an outlet to the air flow passages 54, by which air entering the aerosol chamber through the hole 85 and collecting vapor in the aerosol chamber 82 flows into the air flow passages 54 to the mouthpiece outlets 56.

The atomizer 70 is mounted by insertion of its first end 72 into the liquid flow channel 63 of the flow directing component 60. Hence, in this example, the liquid flow channel 63 acts as a socket for the cantilevered mounting of the atomizer 70. The first end 72 of the atomizer 70 is thus directly fed with liquid entering the liquid flow channel 60 from the reservoir 50, and the liquid is taken up via the porous properties of the atomizer 70 and drawn along the atomizer length to be heated by the heater portion of the atomizer 70 (not shown) which is located in the aerosol chamber 70.

FIGS. 4(A), (B) and (C) show cross-sections through the cartomizer 40 at the corresponding positions along the longitudinal axis of the cartomizer 40.

While aspects of the disclosure are relevant to atomizerss in which the heating aspect is implemented via resistive heating, which requires electrical connections to be made to a heating element for the passage of current, the design of the cartomizer has particular relevance to the use of induction heating. This is a process by which a electrically conducting item, typically made from metal, is heated by electromagnetic induction via eddy currents flowing in the item which generates heat. An induction coil (work coil) operates as an electromagnet when a high-frequency alternating current from an oscillator is passed through it; this produces a magnetic field. When the conducting item is placed in the flux of the magnetic field, the field penetrates the item and induces electric eddy currents. These flow in the item, and generate heat according to current flow against the electrical resistance of the item via Joule heating, in the same manner as heat is produced in a resistive electrical heating element by the direct supply of current. An attractive feature of induction heating is that no electrical connection to the conducting item is needed; the requirement instead is that a sufficient magnetic flux density is created in the region occupied by the item. In the context of vapor provision systems, where heat generation is required in the vicinity of liquid, this is beneficial since a more effective separation of liquid and electrical current can be effected. Assuming no other electrically powered items are placed in a cartomizer, there is no need for any electrical connection between a cartomizer and its power section, and a more effective liquid barrier can be provided by the cartomizer wall, reducing the likelihood of leakage.

Induction heating is effective for the direct heating of an electrically conductive item, as described above, but can also be used to indirectly heat non-conducting items. In a vapor provision system, the need is to provide heat to liquid in the porous wicking part of the atomizer in order to cause vaporization. For indirect heating via induction, the electrically conducting item is placed adjacent to or in contact with the item in which heating is required, and between the work coil and the item to be heated. The work coil heats the conducting item directly by induction heating, and heat is transferred by thermal radiation or thermal conduction to the non-conducting item. In this arrangement, the conducting item is termed a susceptor. Hence, in an atomizer, the heating component can be provided by an electrically conductive material (typically metal) which is used as an induction susceptor to transfer heat energy to a porous part of the atomizer.

Figure 5:
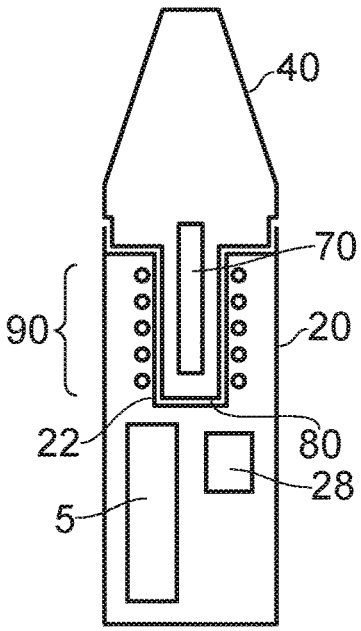
FIG. 5 shows a highly schematic cross-sectional view of a first example vapor provision system employing induction heating in which aspects of the disclosure can be implemented.

FIG. 5 shows a highly simplified schematic representation of a vapor provision system comprising a cartomizer 40 according to examples of the present disclosure and a power component 20 configured for induction heating. The cartomizer 40 may be as shown in the examples of FIGS. 2, 3 and 4 (although other arrangements are not excluded), and is shown in outline only for simplicity. The cartomizer 40 comprises an atomizer 70 in which the heating is achieved by induction heating so that the heating function is provided by a susceptor (not indicated separately). The atomizer 70 is located in the lower part of the cartomizer 40, surrounded by the enclosure 80, which acts not only to define an aerosol chamber but also to provide a degree of protection for the atomizer 70, which could be relatively vulnerable to damage owing to its cantilevered mounting. The cantilever mounting of the atomizer enables effective induction heating however, because the atomizer 70 can be inserted into the inner space of a coil 90, and in particular, the reservoir is positioned away from the inner space of the work coil 90. Hence, the power component 20 comprises a recess 22 into which the enclosure 80 of the cartomizer 40 is received when the cartomizer 40 is coupled to the power component for use (via a friction fit, a clipping action, a screw thread, or a magnetic catch, for example). An induction work coil 90 is located in the power component 20 so as to surround the recess 22, the coil 90 having a longitudinal axis over which the individual turns of the coil extend and a length which substantially matches the length of the susceptor so that the coil 90 and the susceptor overlap when the cartomizer 40 and the power component 20 are joined. In other implementations, the length of the coil may not substantially match the length of the susceptor, e.g., the length of the susceptor may be shorter than the length of the coil, or the length of the susceptor may be longer than the length of the coil. In this way, the susceptor is located within the magnetic field generated by the coil 90. If the items are located so that the separation of the susceptor from the surrounding coil is minimized, the flux experienced by the susceptor can be higher and the heating effect made more efficient. However, the separation is set at least in part by the width of aerosol chamber formed by the enclosure 80, which needs to be sized to allow adequate air flow over the atomizer and to avoid liquid droplet entrapment. Hence, these two requirements need to be balanced against one another when determining the sizing and positioning of the various items.

The power component 20 comprises a battery 5 for the supply of electrical power to energize the coil 90 at an appropriate AC frequency. Also, there is included a controller 28 to control the power supply when vapor generation is required, and possibly to provide other control functions for the vapor provision system which are not considered further here. The power component may also include other parts, which are not shown and which are not relevant to the present discussion.

The FIG. 5 example is a linearly arranged system, in which the power component 20 and the cartomizer 40 are coupled end-to-end to achieve a pen-like shape.

Figure 6:
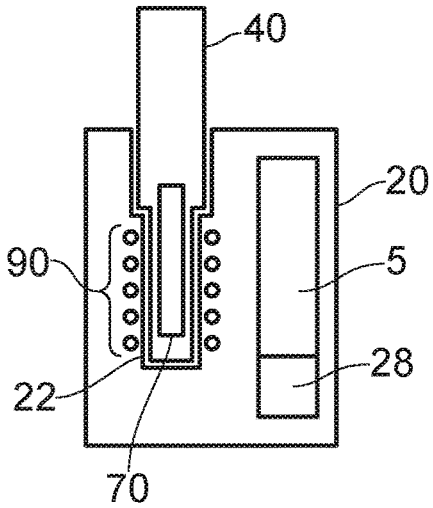
FIG. 6 shows a highly schematic cross-sectional view of a second example vapor provision system employing induction heating in which aspects of the disclosure can be implemented.

FIG. 6 shows a simplified schematic representation of an alternative design, in which the cartomizer 40 provides a mouthpiece for a more box-like arrangement, in which the battery 5 is disposed in the power component 20 to one side of the cartomizer 40. Other arrangements are also possible.

The atomizer 70 may be configured in any of several ways that provide it both with porosity in order to absorb liquid from the reservoir and carry it to the susceptor, and with electrical resistance/conductivity in order for the susceptor to operate as a heater to vaporize the liquid. Hence, the atomizer can broadly be defined as having porosity and comprising a susceptor for induction heating. Various examples for implementing these functions are described further below.

Regardless of the implementation of the porosity and induction heating capabilities, the atomizer 70 has an elongate shape extending between a first end and a second end. By "elongate" it is meant that the atomizer is dimensioned such that its size (length) in a direction extending between the first end and the second end is larger, typically significantly larger, that its size (width) in a direction orthogonal to the length. For example, the length may be at least two times the width, or at least five times the width, or at least ten times the width. These are examples only and other proportions are not excluded.

Furthermore, the elongate atomizer is mounted in a cantilevered arrangement, as noted above.

Figure 7:
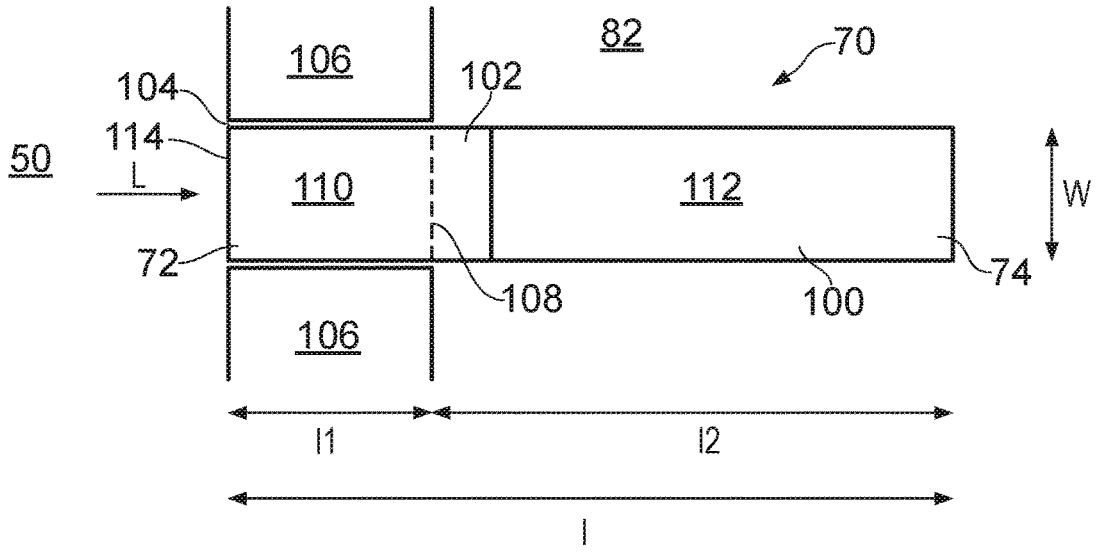
FIG. 7 shows a schematic cross-sectional side view of a cantilevered atomizer according to an example.

FIG. 7 shows a highly schematic representation of an example atomizer mounted to form a cantilever. The atomizer 70 has an elongate shape with a length l, being its larger dimension which extends between a first end 72 and a second end 74. The atomizer has a width w substantially orthogonal to its length l. The atomizer 70 has a porosity attributable to a porous part, portion or element 102, and also comprises a susceptor 100 for induction heating made from an electrically conductive/resistive material, for example a metal. In FIG. 7 the susceptor 100 and the porous element 102 are shown highly schematically as adjacent components; more detailed arrangements are described in below. However, the susceptor 100 includes the second end 74 of the atomizer 70, which is located in an aerosol chamber 82.

A socket 104, being an opening or aperture through a component 106 which may be a reservoir housing, a flow directing member, or an enclosure, all as described above, or indeed some other component, is utilizedutilised in order to support the atomizer 70 in a cantilevered configuration. This is achieved by inserting the first end 72 of the atomizer 70 into the socket 104. The socket 104 is sized so as to have a width (or cross-sectional area) the same as or similar to the width w (or cross-sectional area) of the atomizer 70 so that the atomizer 70 is gripped within the socket 104. If the component 106 in which the socket 104 is formed is made from a flexible resilient material such as silicone or rubber (natural or synthetic), the atomizer 70 can be held securely gripped by the socket 104, perhaps due to some compression of the socket material by the inserted atomizer. Otherwise a friction fit may be utilizedutilised if the materials of the socket 104 and the atomizer first end 72 have suitable surface properties. Alternatively, adhesive or a similar material might be used to permanently or temporarily fix the atomizer 70 in place within the socket 104.

The location of the atomizer 70 in the socket 104 demarcates two zones or portions of the atomizer 70, divided by the plane 108 which is in line with the face of the socket 104 facing the aerosol chamber 82. The portion of the atomizer 70 lying between the plane 108 and the first end 72 of the atomizer 70 inserted into the socket 104 is a supported or mounted portion 110, since it is supported by the socket 104. In this example, the supported portion is wholly surrounded or encircled by the socket 104. The portion of the atomizer 70 lying between the plane 108 and the second end 74 of the atomizer 70 is an unsupported portion 112, extending outwardly from external dimensions of the reservoir volume 50 and within the aerosol chamber 82. The second end 74 is therefore unsupported by any physical contact with another component, and the portion 112 is a cantilever portion of the atomizer 70. The atomizer 70 is therefore held, mounted or supported in a cantilevered arrangement or configuration, with a supported first end 72 and an unsupported second end 74. The susceptor 100 at least partly, and in this example wholly, comprised within the cantilever portion 112 and therefore lies within the aerosol chamber 82 and is located outside the external boundaries or dimensions of the reservoir 50.

At noted above, the atomizer 70 has a length l. The mounted portion 110 has a length l1, and the cantilever portion 112 has a length l2, such that l1+l2=l. Typically, the cantilever portion 112 will have a greater length that the mounted portion 110, so that l2>l1. With reference to the whole length of the atomizer 70, the mounted portion may therefore occupy less than 50% of the atomizer, so that l1<l/2. In more particular examples, l1 may be a proportion of the total length l in the range of substantially 15% to 40%, or 20% to 35%, or 23% to 27%, or substantially 25%.

In terms of numerical values, the length l1 of the mounted portion may in the range of about 2 mm to 6 mm, or about 3 mm to 5 mm, for example about 4 mm. Lengths greater than about 6 mm are typically unnecessary in terms of providing support and hence waste material and increase costs. Lengths less than about 2 mm provide insufficient support and an undesirably weak hold on the atomizer.

A purpose of the cantilevered arrangement of the atomizer 70 is to enable the susceptor to be located for efficient coupling of magnetic flux from the work coil that drives the induction heating. For a given flux density, this coupling is made most effective by use of a minimum separation between a susceptor and a coil, and minimum structural features lying between a susceptor and its coil. Therefore, more traditional locations of an electrical heating element in a vapor provision system such as within a region bounded by an outer wall of a reservoir (a typically position for a resistive heating element in the inner space of an annular reservoir) are poorly suited for induction heating, since the presence of the reservoir increases the distance between the coil and the susceptor, and may block or interfere with the magnetic field. The cantilevered arrangement takes the susceptor outside of the reservoir boundaries, and also frees an end of the susceptor/atomizer from physical connection to other components so that the susceptor can be inserted inside a helical induction work coil, enabling close proximity to the coil and hence an efficient coupling of the magnetic flux.

In the FIG. 7 example, the first end 72 of the atomizer 70 is inserted into the socket 106 so that the end face 114 of the first end 72 is substantially flush with the face of the socket facing towards the reservoir. This end face 114 receives liquid L delivered from the reservoir 50 (via a liquid flow channel in a flow directing member, for example), and absorbs the liquid and carries it by wicking towards the second end 74 of the atomizer 70 so that it comes within the heating range of the susceptor portion 112 for vaporization.

Figure 8:
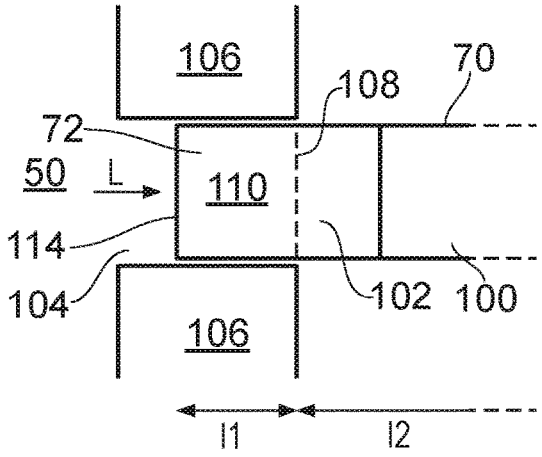
FIG. 8 shows a schematic cross-sectional side view of a cantilevered atomizer according to an alternative example.

FIG. 8 shows a schematic representation of an alternative example of a cantilevered atomizer 70 held in a socket 104 of a component 106. In this example, the first end 72 of the atomizer 70 is inserted less far into the socket 104, so that the end face 114 of the atomizer 70 is located at a plane intermediate between the face of the socket 104 facing towards the reservoir 50 and the face of the socket 104 facing towards the aerosol chamber 82. As before, the mounted or supported portion 110 has a length l1 that extends between the plane 108 and the first end 72 of the atomizer 70, although in this case the length l1 is shorter than the depth of the socket 104.

Figure 9:
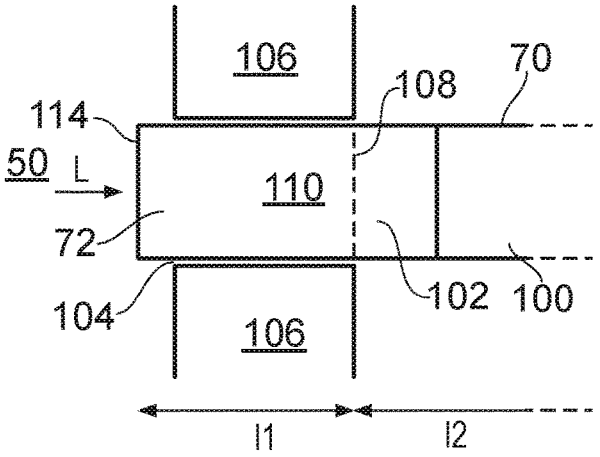
FIG. 9 shows a schematic cross-sectional side view of a cantilevered atomizer according a further alternative example.

FIG. 9 shows a schematic representation of an alternative example of a cantilevered atomizer 70 held in a socket 104 of a component 106. In this example, the first end 72 of the atomizer 70 is inserted further into the socket 104 so that the first end 72 protrudes beyond the socket 104 and the end face 114 is located outside the socket 104 on the reservoir side. As before, though, the mounted portion of length l1 is considered to be that part of the atomizer 70 that lies between the plane 108 and the first end 72, even though a part of the mounted portion 110 is external to the socket 106 (not surrounded by the material of the component 106). This part is considered to be not relevant compared to the length l2 of the cantilever portion, so can be considered to be mounted as regards the aim of providing a cantilevered atomizer that extends outwardly into an aerosol chamber. The protruding part of the mounted portion 110 can be provided so as to give a larger surface area of the atomizer able to receive liquid L arriving from the reservoir 50, thus improving the efficiency of the liquid delivery to the susceptor.

Various designs of atomizer may be utilized in the cantilevered configuration. In some examples, the porosity is provided by use of a porous ceramic component or element that acts as a wick to absorb liquid from the reservoir and carry it by wicking or capillary action to the vicinity of the susceptor. For example, a porous ceramic rod may be used, having a generally elongate shape, and a cross sectional shape that may be substantially circular (which removes any requirement for particular alignment during assembly of a cartomizer), or oval, or square, or rectangular or any other shape. The socket may have a corresponding cross-sectional size and shape, or merely have similar dimensions and a size large enough to accommodate an end of the rod so that the atomizer can be inserted into the socket as required. However, a matching size and shape will provide a better seal to limit leakage of free liquid from the reservoir into the aerosol chamber.

Figure 10:
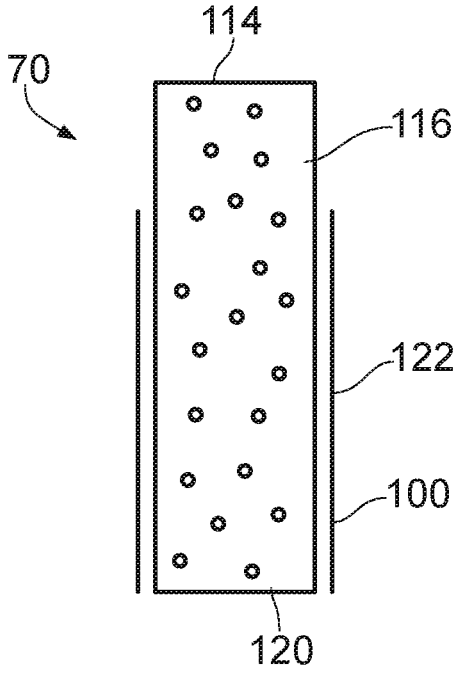
FIG. 10 shows a cross-sectional schematic side view of an elongate atomizer comprising a porous ceramic rod according to an example.

FIG. 10 shows a cross-sectional side view of an example atomizer based on a porous ceramic rod. As before, the ceramic rod 116 extends the full length of the atomizer 70. The susceptor 100 is embodied as a metal layer 122 which wraps the ceramic rod 116 around its outer side surface. The metal layer 122 is formed from a planar sheet of metallic material, for example. The sheet may be rolled, folded or curled into a suitable shape that allows the layer to conform to the outer shape and surface of the ceramic rod 116, so as to be in contact or close contact with the outer surface of the rod 116. In this example, the end surface 120 of the rod is not covered by the metal layer, but in some examples, the metal layer may cover the end surface 120 also. The metal layer 122 does not cover the first end of 72 of the ceramic rod 116, leaving an uncovered part by which the atomizer 70 can be mounted without delivering heat to the supporting socket. The metal layer 122 may be provided with perforations or other holes to enable vapor generated from liquid in the porous ceramic rod 116 to escape more easily from the atomizer 70 into the aerosol chamber 82.

Figure 10A:
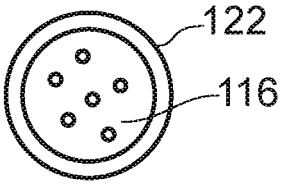
FIGS. 10A-10C show transverse cross-sectional views of the atomizer of FIG. 10 according to different configurations of susceptor.
Figure 10B:
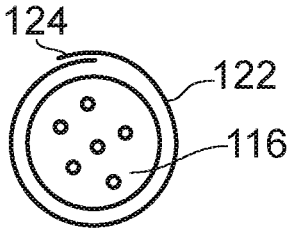
Figure 10C:
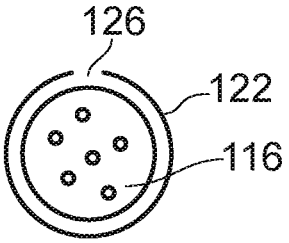

FIGS. 10A, 10B and 10C show transverse cross-sectional views of various configurations of the example atomizer of FIG. 10. Each has a circular shape in this transverse plane, but this is not essential; other shapes may be used. FIG. 10A shows an example in which the metal layer 122 is configured as a hollow tube closed around its circumference (such as by seaming the two edges of a rolled metal sheet), into which the ceramic rod 116 can be inserted. FIG. 10B shows an example in which the metal layer 122 is configured again as a hollow tube, but unseamed so that it comprises two edges which overlap in an unjoined manner and are free to slide over one another in an overlap region 124 to alter the circumference of the tube. This can be formed by rolling a metal sheet into a tubular shape. This shape allows the tube to be enlarged somewhat for ease of insertion of the ceramic rod 116, and it can contract again after insertion under the biasing forces of the tubular shape, so as to give a close contact of the metal layer 122 to the rod 116. FIG. 10C shows a similar example in which the metal tube has two edges which are not joined to one another, but also do not overlap so that the metal tube 122 does not fully encircle the rod 116. A gap 126 exists between the two edges of the rolled metal sheet. Again, this allows the tube to be enlarged during assembly of the atomizer and to contract afterwards to contact the outer surface of the rod 116. Also, the gap allows the escape of vapor, so perforations in the metal sheet may not be necessary.

The examples of FIGS. 10 and 10A-C may alternatively be configured with a porous element other than a porous ceramic rod. The hollow tubular shape of the metal sheet layer 122 can be filled with porous material such as material comprising fibers (fibrous material), woven, nonwoven, wadded or bundled together in order to form an absorbent structure with pores or capillary gaps. For example, the fibrous material may comprise cotton, including organic cotton.

In any of the FIGS. 10 and 10A-C examples, the susceptor 100 may not reach as far as the plane 108 between the supported portion 110 and the cantilever portion 112 of the atomizer or may reach only as far as this plane to avoid delivering heat to the socket material. Alternatively, the susceptor may reach past this plane 108, possibly extending to the first end of the atomizer 70, if the socket material can withstand heat exposure at the temperatures to which the susceptor 100 is heated. The end face 114 of the ceramic rod 116 at the first end 72 should be left uncovered by the metallic layer in order to allow ingress of liquid, however.

Figure 11:
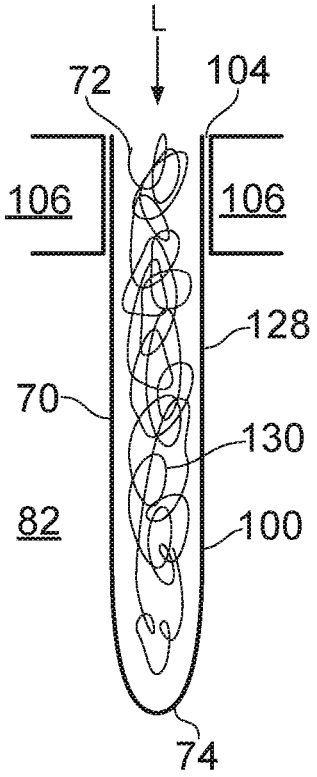
FIG. 11 shows a schematic side view of a cantilevered atomizer comprising a folded metal susceptor according to an example.

FIG. 11 shows a cross-sectional side view of a further example of an atomizer 70, similar to that of FIG. 3. The atomizer 70 is shown mounted at its first end 72 in a socket 104 of a component 106, as before. The susceptor 100 comprises an elongate planar metal element 128 originally twice the desired length of the atomizer 70, which is folded or bent across its width roughly midway along its length in order to bring its two short ends adjacent to one another. These adjacent short ends form the first end 72 of the atomizer 70 which is inserted into the socket 104. The folded shape may give an outward bias to the two ends (they are biased towards the unfolded configuration of the planar element) so that they press outwardly against the sides of the socket 104 and act to keep the atomizer in its mounted position. The fold forms the second end 74 of the atomizer 70. The two halves, brought near to one another by the fold, define a volume, space or open cavity to hold a porous element 130 for wicking of liquid L from the reservoir to the susceptor 100. The porous element 130 is effectively sandwiched between the two halves of the folded susceptor 100. The open sides of the cavity allow the escape of vapor into the aerosol chamber 82. The porous element 130 may comprise fibers or fibrous material as described above with regard to FIG. 10, such as cotton or porous cotton.

Figure 12:
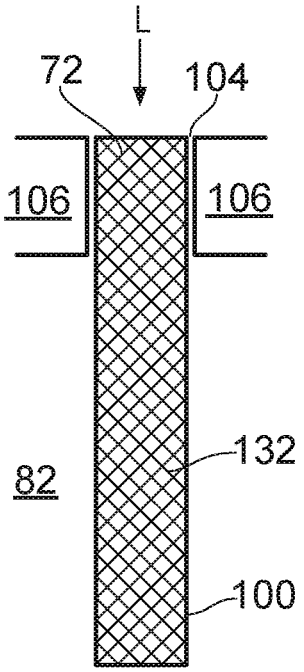
FIG. 12 shows a schematic side view of a cantilevered atomizer formed from porous metal material according to another example.

FIG. 12 shows a cross-sectional side view of a further example of an atomizer 70, again mounted at its first end 72 in a socket 104 of a component 106. In this example, the atomizer is comprised of a material which is able to provide both the porous wicking function and the susceptor function, and formed from this material as an elongate monolithic element. For example, it may comprise an electrically resistive material such as a metal which is formed into a porous structure, such as by sintering together of metallic fibers or beads, or by weaving or otherwise enmeshing fibers to form a mesh or grid structure. The mesh or grid might be fabricated as a sheet, which could be cut to size and shape and used in its flat form, or folded, rolled or bent into some other shape.

As described with regard to FIGS. 5 and 6, the cartomizer comprises an enclosure placed around the cantilevered atomizer to form an aerosol chamber and which is inserted into a suitably shaped recess or cavity 22 in a power component 20 in order to bring the susceptor into the working range of an induction work coil 90. The atomizer, inside the enclosure, is inserted into the open space inside a helical coil.

The enclosure performs a number of functions. It defines the aerosol chamber around the atomizer. If it is closed at the base, it can collect any free liquid that has not been vaporized or which has condensed out of the generated aerosol, and hence reduce leakage out of the cartomizer. Also, it protects the atomizer, which in its cantilevered position, extending outwardly from the space occupied by the reservoir, is potentially vulnerable to damage when the cartomizer is separated from the power component. However, the enclosure is not essential, and the cantilevered atomizer can be implemented without an enclosure.

Figure 13:
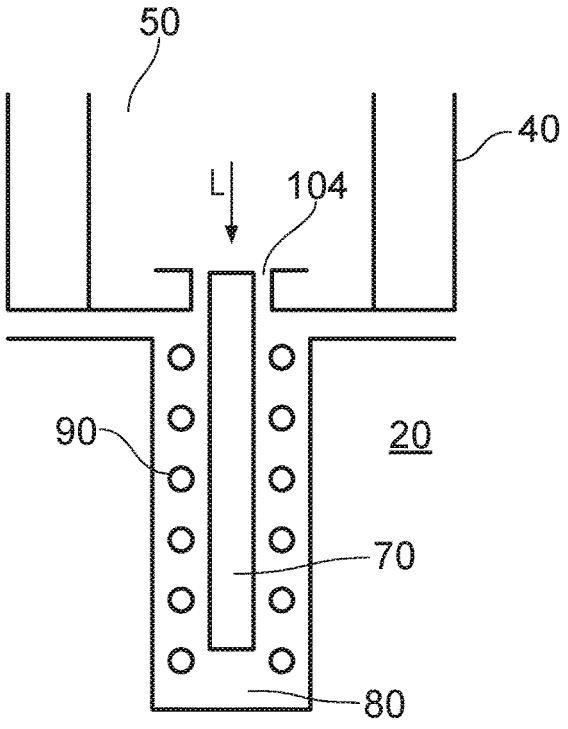
FIGS. 13 and 14 show schematic cross-sectional side views of part of example vapor provision systems with a cantilevered atomizer and induction heating.

FIG. 13 shows a highly simplified schematic cross-sectional side view of part of a vapor generation system with a cantilevered atomizer and lacking an aerosol chamber enclosure which is part of the cartomizer portion. As before, the atomizer 70 is supported in a cantilevered fashion by a socket 104 formed in a component at the base of a reservoir 50 of a cartomizer 40 (alternatively, the system may be configured as a unitary device in which the cartomizer part is configured as an aerosol generation part which is not separable from the rest of the system). A power component 20 has a recess 80 which houses a work coil 90 with a helical shape arranged with its longitudinal axis along the direction of the atomizer 70. The cantilevered portion of the atomizer 70, including at least part of the susceptor (not shown specifically), is inserted into the recess 80 so that the susceptor is located inside the helix of the work coil 90 for induction heating when alternating current is passed through the coil 90. The recess 80 and the coil 90 cooperate to form an aerosol chamber around the atomizer 70. The coil 90 can be in close proximity to the susceptor, and there are no intervening parts between the coil and the susceptor, so the efficiency of the induction heating can be maximized.

Figure 14:
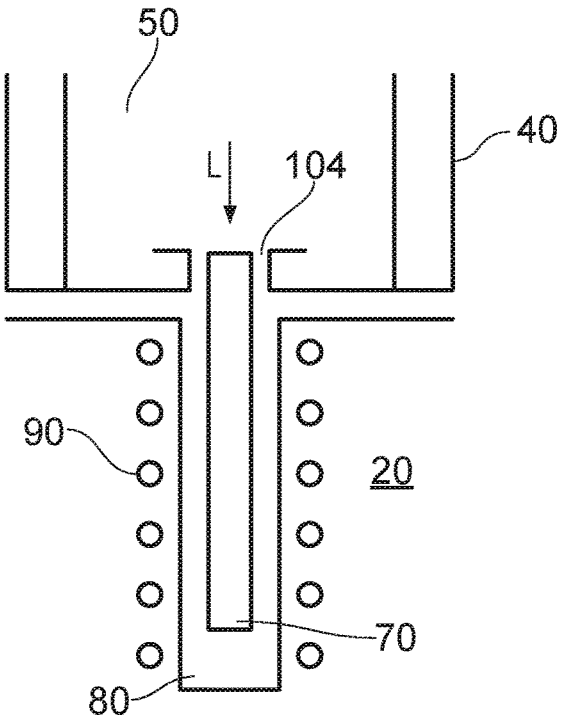

FIG. 14 shows a highly simplified schematic cross-sectional side view of part of a vapor generation system according to another example. As in FIG. 13, there is no enclosure around the cantilevered susceptor 70 comprised in the cartomizer portion 40. This design differs from the FIG. 13 arrangement in that the coil 90 is located inside a housing of the power component 20 (which may or may not be separable from the parts of the cartomizer component) so as to surround the recess 80, rather than being located inside the recess. Hence, the coil 90 and the susceptor are separated by the material of the housing (which need not be thick) so the efficiency may be somewhat reduced compared to the FIG. 14 example, but the coil is protected from any leakage of liquid.

In conclusion, in order to address various issues and advance the art, this disclosure shows by way of illustration various embodiments in which the claimed invention(s) may be practiced. The advantages and features of the disclosure are of a representative sample of embodiments only, and are not exhaustive and/or exclusive. They are presented only to assist in understanding and to teach the claimed invention (s). It is to be understood that advantages, embodiments, examples, functions, features, structures, and/or other aspects of the disclosure are not to be considered limitations on the disclosure as defined by the claims or limitations on equivalents to the claims, and that other embodiments may be utilized and modifications may be made without departing from the scope of the claims. Various embodiments may suitably comprise, consist of, or consist essentially of, various combinations of the disclosed elements, components, features, parts, steps, means, etc. other than those specifically described herein. The disclosure may include other inventions not presently claimed, but which may be claimed in future.

The invention claimed is:

1. An aerosol source for an electronic vapor provision system, comprising:

a reservoir housing defining a reservoir for holding aerosolizable substrate material; and an elongate atomizer to which aerosolizable substrate material from the reservoir is deliverable for vaporization, the atomizer having a porosity and comprising a susceptor for induction heating, and having a first end and a second end, the atomizer mounted at one of its ends only so as to be supported at the mounted end in a cantilevered arrangement having an unsupported cantilever portion, such that the susceptor extends outwardly with respect to an exterior boundary of the reservoir housing, the aerosol source further comprising a socket formed on the reservoir housing or on a component coupled to the reservoir housing into which the mounted end of the atomizer is inserted to mount the atomizer such that an end face of the mounted end receives aerosolizable substrate material from the reservoir; and wherein the location of the atomizer in the socket demarcates two portions of the atomizer, divided by a plane which is in line with a face of the socket, and wherein the portion of the atomizer lying between the plane and the second end of the atomizer is unsupported.

2. An aerosol source according to claim 1, further comprising a flow directing member on which the socket is formed, the flow directing member coupled to the reservoir housing to seal the reservoir and having channels for the flow of aerosolizable substrate material from the reservoir to the atomizer and for the flow of aerosol formed by the atomizer to an air flow passage.

3. An aerosol source according to claim 1, further comprising aerosolizable substrate material in the reservoir.

4. A cartridge for an electronic vapor provision system comprising an aerosol source according to claim 1.

5. An electronic vapor provision system comprising an aerosol source according to claim 1, further comprising a coil configured to receive electrical power in order to heat the susceptor by induction heating.

6. An electronic vapor provision system according to claim 5, wherein the coil is located directly adjacent to the atomizer.

7. An electronic vapor provision system according to claim 5, wherein the coil is separated from the atomizer by one or more walls defining an aerosol chamber in which at least part of the cantilever portion is located and/or by one or more walls of a housing of the coil.

8. An aerosol source according to claim 1, wherein the atomizer has a length between the first end and the second end that includes a mounted portion and an unsupported cantilever portion, wherein the mounted portion is in the range of about 15% to 40% of the length.

9. An aerosol source according to claim 8, wherein the mounted portion is in the range of about 20% to 35% of the length.

10. An aerosol source according to claim 9, wherein the mounted portion is in the range of about 25% of the length.

11. An aerosol source according to claim 1, wherein the atomizer comprises a porous element adjacent the susceptor to deliver aerosolizable substrate material from the reservoir to the susceptor for vaporization.

12. An aerosol source according to claim 11, wherein the porous element comprises a ceramic rod and the susceptor comprises a metallic sheet layer overlying at least part of the cantilever portion.

13. An aerosol source according to claim 12, wherein the metallic sheet layer comprises a hollow metal tubular element within which the ceramic rod is located.

14. An aerosol source according to claim 11, wherein the porous element comprises a portion of fibrous material and the susceptor comprises a portion of metallic sheet material shaped to define an interior space in which the fibrous material is held.

15. An aerosol source according to claim 14, wherein the fibrous material comprises cotton or organic cotton.

16. An aerosol source according to claim 11, wherein the atomizer comprises a portion of porous electrically conductive material configured both to provide the porosity and to operate as the susceptor.

17. An aerosol source according to claim 1, further comprising an enclosure extending from the reservoir housing to define an aerosol chamber in which at least part of the cantilever portion is located.

18. An aerosol source according to claim 17, wherein the enclosure is formed integrally with the reservoir housing.

19. An aerosol source according to claim 17, wherein the enclosure is coupled to the reservoir housing.

* * * * *